US009895039B2

(12) United States Patent
Matsumoto

(10) Patent No.: US 9,895,039 B2
(45) Date of Patent: Feb. 20, 2018

(54) INDOOR UNIT OF AIR-CONDITIONING APPARATUS

(71) Applicant: Mitsubishi Electric Corporation, Tokyo (JP)

(72) Inventor: Takashi Matsumoto, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 787 days.

(21) Appl. No.: 13/951,530

(22) Filed: Jul. 26, 2013

(65) Prior Publication Data

US 2014/0041145 A1 Feb. 13, 2014

(30) Foreign Application Priority Data

Aug. 10, 2012 (JP) ..... 2012-178681

(51) Int. Cl.

| | |
|---|---|
| ***A47L 9/28*** | (2006.01) |
| ***F24F 1/02*** | (2011.01) |
| ***F24F 11/02*** | (2006.01) |
| ***F25B 49/00*** | (2006.01) |

(Continued)

(52) U.S. Cl.

CPC ..... *A47L 9/2894* (2013.01); *F24F 1/0011* (2013.01); *F24F 11/0078* (2013.01); *F25B 49/00* (2013.01); *F24F 2001/0048* (2013.01); *F24F 2221/18* (2013.01); *Y10S 901/01* (2013.01); *Y10S 901/40* (2013.01)

(58) Field of Classification Search

CPC ..... A47L 2201/00; A47L 2201/06; A47L 9/2805; A47L 9/2836; A47L 9/2889

See application file for complete search history.

(56) References Cited

U.S. PATENT DOCUMENTS 5,787,545 A * 8/1998 Colens ..... A47L 5/28 15/319

2006/0064204 A1 3/2006 Kim et al.

(Continued)

FOREIGN PATENT DOCUMENTS

CN 203595236 U 5/2014
JP 07-271426 A 10/1995

(Continued)

OTHER PUBLICATIONS

Office Action dated, Jul. 30, 2015 in corresponding CN patent application No. 201310345053.2 (with English Translation).

(Continued)

*Primary Examiner* — Joseph J Hail
*Assistant Examiner* — Jon Taylor
(74) *Attorney, Agent, or Firm* — Posz Law Group, PLC

(57) ABSTRACT

An air-conditioning apparatus indoor unit that includes a controller is described. In an automatic cleaning mode, when having determined on the basis of an image captured by an imaging device that there is no person in a room, the controller causes air to be blown for a predetermined time to a stationary three-dimensional object identified using the image captured by the imaging device. After the predetermined time has elapsed, the controller causes air blowing to the stationary three-dimensional object to be stopped, and issues an operation instruction for an autonomous vacuum cleaner to clean and move in the room.

16 Claims, 8 Drawing Sheets

(51) Int. Cl.
*F24F 1/00* (2011.01)
*F24F 11/00* (2018.01)

(56) References Cited

U.S. PATENT DOCUMENTS

| | | | | |
|---|---|---|---|---|
| 2007/0124702 | A1* | 5/2007 | Morisaki | G06F 3/017 715/863 |
| 2010/0234998 | A1* | 9/2010 | Kim | A47L 9/2805 700/259 |
| 2012/0222224 | A1* | 9/2012 | Yoon | A47L 11/33 15/52.1 |
| 2014/0041145 | A1 | 2/2014 | Matsumoto | |

FOREIGN PATENT DOCUMENTS

| | | | |
|---|---|---|---|
| JP | 2002-209818 | A | 7/2002 |
| JP | 2003-079540 | A | 3/2003 |
| JP | 2006-090700 | A | 4/2006 |
| JP | 2009-103328 | A | 5/2009 |
| JP | 2010-162263 | A | 7/2010 |
| JP | 2011-080625 | A | 4/2011 |
| JP | 2011-196593 | A | 10/2011 |
| JP | 2012-042131 | A | 3/2012 |
| WO | 20101109557 | A1 | 9/2010 |

OTHER PUBLICATIONS

Office Action dated Dec. 9, 2014 in the corresponding JP application No. 2012-178681 (and English translation).

* cited by examiner

INDOOR UNIT OF AIR-CONDITIONING APPARATUS

TECHNICAL FIELD

The present invention relates to indoor units of air-conditioning apparatuses, and more specifically, it relates to an air-conditioning apparatus indoor unit including imaging unit capable of capturing an image of a room.

BACKGROUND ART

An indoor-unit control system has been developed that controls an autonomous vacuum cleaner to facilitate simplification of the structure of the autonomous vacuum cleaner (refer to Patent Literature 1, for example).

CITATION LIST

Patent Literature

[Patent Literature 1] Japanese Unexamined Patent Application Publication No. 7-271426 (pp. 6-7, FIG. 15)

SUMMARY OF INVENTION

Technical Problem

The indoor-unit control system disclosed in Patent Literature 1 includes a device controller, an autonomous vacuum cleaner, and an air-conditioning apparatus. The device controller is provided with a camera unit that captures an image of a room. The control system is capable of distinguishing a stationary object and a moving object on the basis of the captured image.

The control system can therefore identify an obstacle in the room using a stationary object detecting function and detect motion of the autonomous vacuum cleaner using a moving object detecting function. Accordingly, a control instruction is determined in accordance with vacuum cleaner traveling algorithms for, for example, obstacle avoidance, overlapping traveling avoidance in principle, and fundamental compliance with the previous optimal way of traveling. Various instructions for traveling, stopping, rotation, speed, and the like are converted into signals and the signals are transmitted to the autonomous vacuum cleaner. When receiving the signals, the autonomous vacuum cleaner efficiently cleans the room in accordance with the instructions while avoiding a person or an obstacle. Accordingly, it is only required that the autonomous vacuum cleaner has an operation function and a stop function. The autonomous vacuum cleaner has a very simple structure because it does not need a camera and a sensor.

Furthermore, the position of a user (person) in the room can be similarly identified. Accordingly, the air-conditioning apparatus can blow conditioned air to the user (or so as to avoid the user).

Although the indoor-unit control system disclosed in Patent Literature 1 can facilitate simplification of the structure of the autonomous vacuum cleaner, the system has to include the device controller provided with the camera unit. Disadvantageously, the control system is expensive therefor.

Furthermore, the device controller has to be disposed on a ceiling. This involves troublesome installation work. In addition, disadvantageously, such an additional object protruding from the ceiling degrades the appearance of the room.

The present invention intends to overcome the above-described disadvantages and meet the above-described requirements, and relates to controlling an autonomous vacuum cleaner without any special device controller. More particularly, the invention relates to effective utilization of an indoor unit of an air-conditioning apparatus.

Solution to Problem

The present invention provides an air-conditioning apparatus indoor unit that includes a body to be disposed on a wall of a room, the body having an air inlet and an air outlet, an air-sending device sucking indoor air through the air inlet to provide an air path leading to the air outlet, a heat exchanger disposed in the air path, the heat exchanger serving as part of a refrigeration cycle, a blowing direction control device disposed in the air outlet, the blowing direction control device controlling a blowing direction of air conditioned by the heat exchanger, an imaging device capturing an image of inside of the room, and a controller controlling the air-sending device, the refrigeration cycle, and the blowing direction control device on the basis of an image captured by the imaging device. The controller has an automatic cleaning mode for controlling an autonomous vacuum cleaner and controls the autonomous vacuum cleaner in the automatic cleaning mode on the basis of an image captured by the imaging device.

Advantageous Effects of Invention

The air-conditioning apparatus indoor unit according to the present invention includes the imaging device. The controller controls the air-sending device, the refrigeration cycle, and the blowing direction control device and has a function for controlling the autonomous vacuum cleaner on the basis of an image captured by the imaging device. It is therefore unnecessary to additionally install a dedicated device controller to control the autonomous vacuum cleaner. Accordingly, installation work is not needed. The autonomous vacuum cleaner can be controlled at low cost. Furthermore, since any additional object does not protrude from a ceiling, a desirable appearance of a room can be maintained.

DESCRIPTION OF EMBODIMENTS

Embodiment 1

Figure 1:
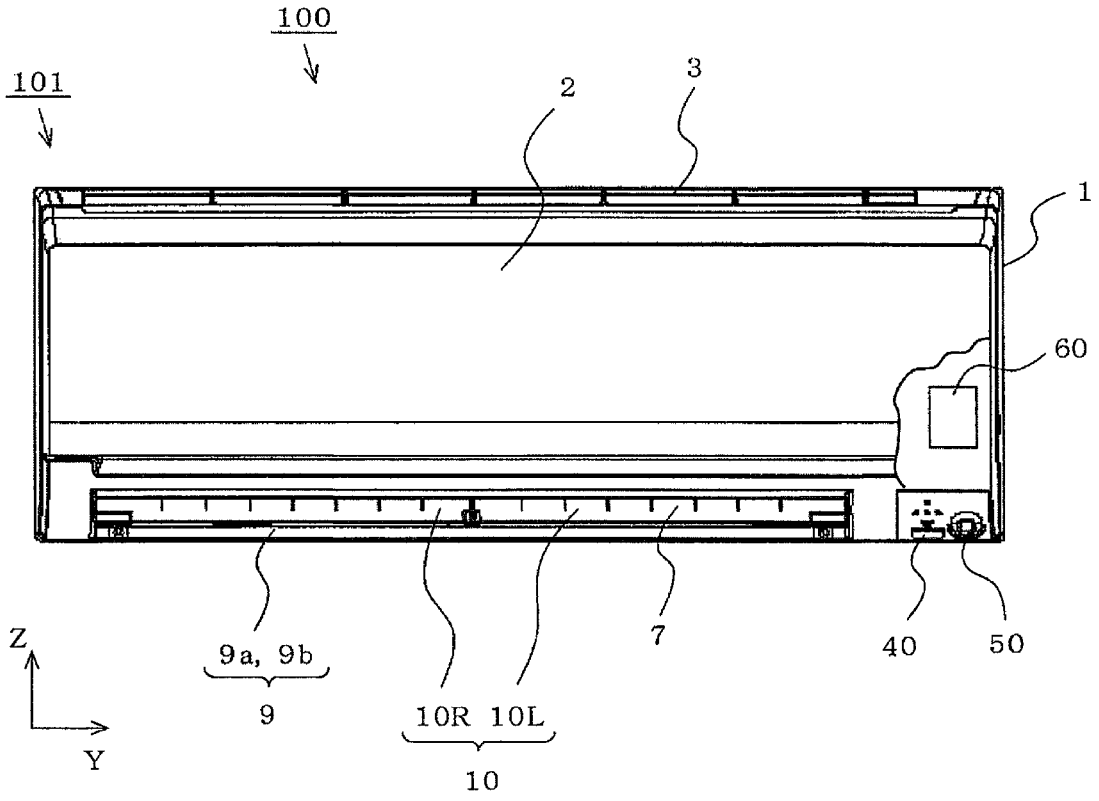
FIG. 1 is a front view illustrating an air-conditioning apparatus indoor unit according to Embodiment 1 of the present invention.
Figure 2:
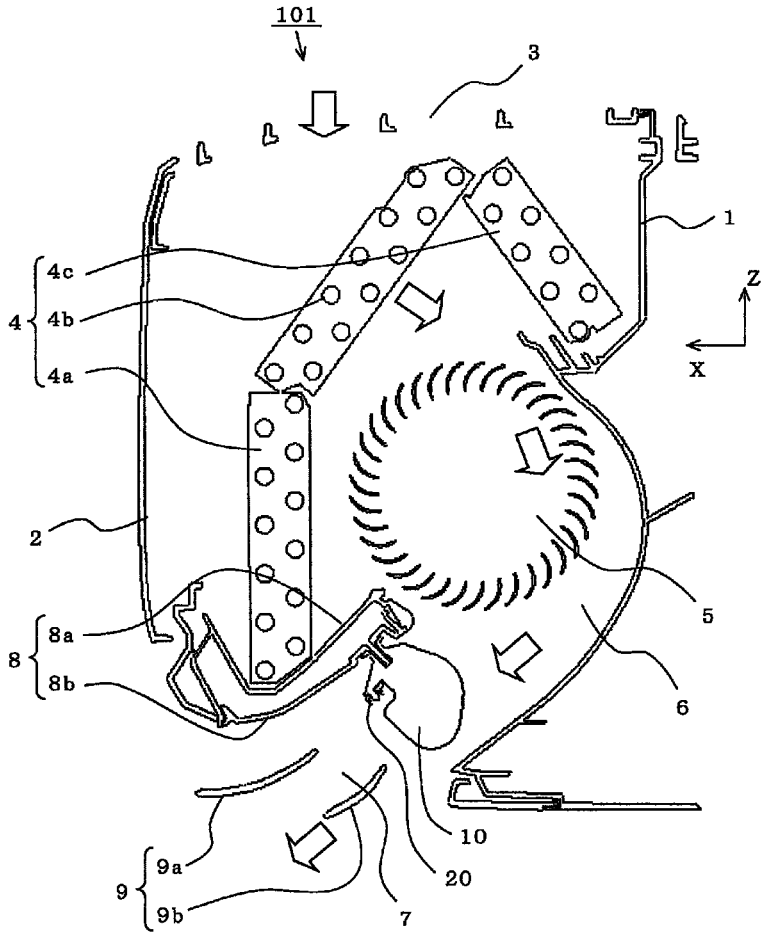
FIG. 2 is a side view of the indoor unit of FIG. 1 in cross-section.
Figure 3:
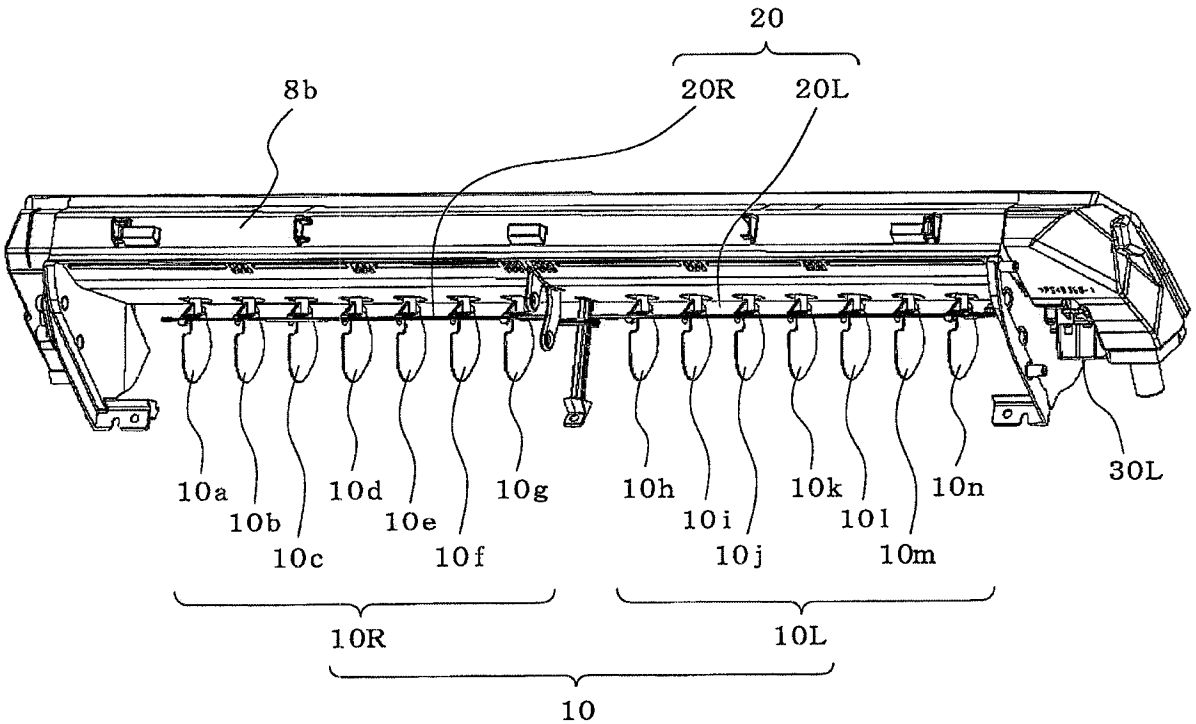
FIG. 3 is a perspective view of part (in the vicinity of an air outlet) of the indoor unit of FIG. 1.
Figure 4:
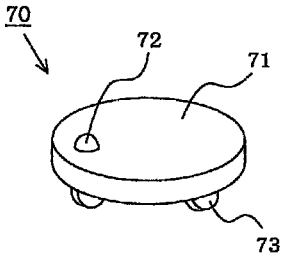
FIG. 4 is a perspective view of an autonomous vacuum cleaner that receives an operation signal from the indoor unit of FIG. 1.
Figure 5:
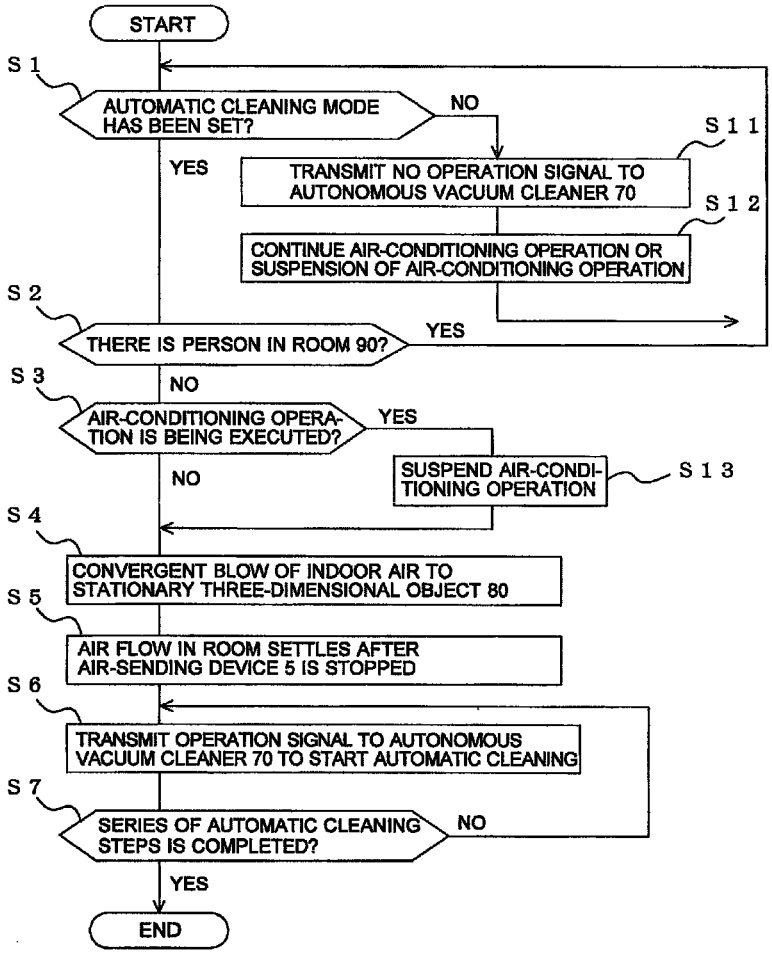
FIG. 5 is a flowchart explaining the steps of automatic cleaning by the indoor unit of FIG. 1.
Figure 6:
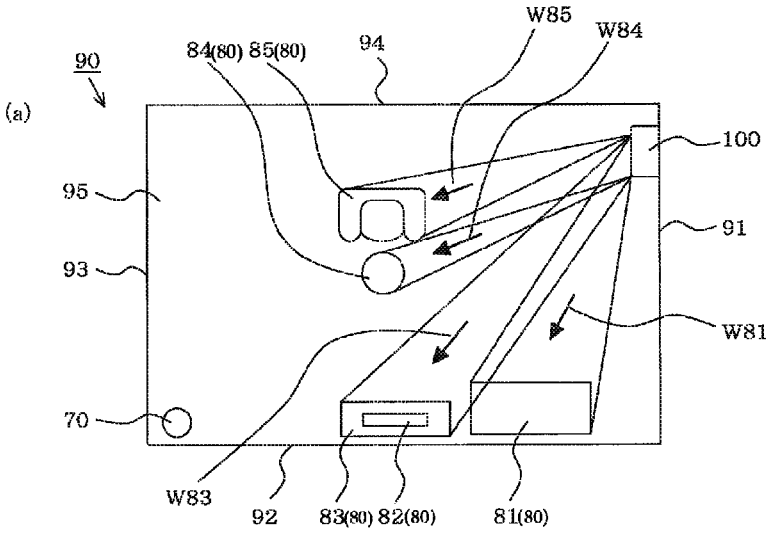
FIG. 6 includes a plan view explaining an example of convergent blow in automatic cleaning by the indoor unit of FIG. 1 and a plan view explaining exemplary cleaning areas in automatic cleaning.
Figure 6:
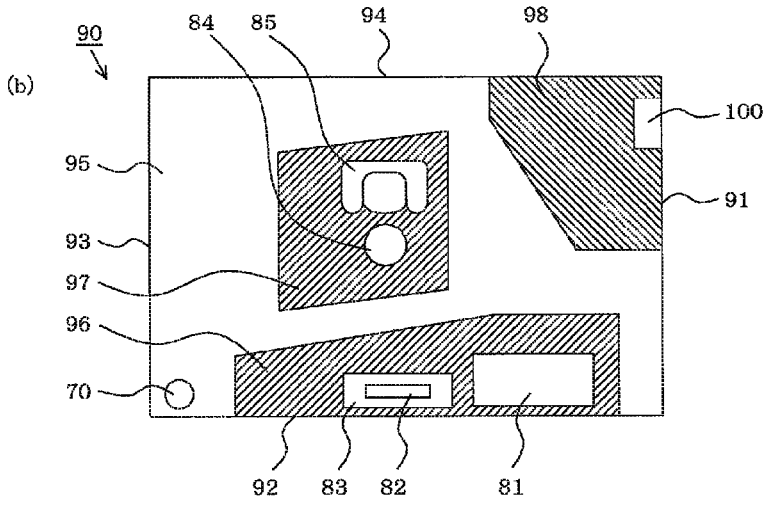

FIGS. 1 to 6 are diagrams explaining an air-conditioning apparatus indoor unit according to Embodiment 1 of the present invention. FIG. 1 is a front view of the indoor unit. FIG. 2 is a side view of the indoor unit in cross-section. FIG. 3 is a perspective view of part (in the vicinity of an air outlet) of the indoor unit. FIG. 4 is a perspective view of an autonomous vacuum cleaner that receives an operation signal from the indoor unit. FIG. 5 is a flowchart explaining the steps of automatic cleaning. FIG. 6(*a*) is a plan view explaining an example of convergent blow in automatic cleaning. FIG. 6(*b*) is a plan view explaining exemplary cleaning areas in automatic cleaning. Note that the figures are schematically illustrated and the invention is not limited to the illustrated embodiment.

(Indoor Unit)

As illustrated in FIGS. 1 to 3, an air-conditioning apparatus indoor unit (hereinafter, referred to as an "indoor unit") 100 includes a body 1 having an air inlet 3 positioned in upper part of the body and an air outlet 7 positioned in lower part thereof, a front panel 2 openably covering the front of the body 1, an air-sending device 5 sucking indoor air through the air inlet 3 to provide an air path 6 leading to the air outlet 7, and a heat exchanger 4 positioned upstream of the air-sending device 5 (i.e., adjacent to the air inlet 3).

The indoor unit 100 further includes a transmitting device 40 to transmit an operation signal to an autonomous vacuum cleaner 70 (refer to FIG. 4) and an imaging device 50 to capture an image of a room such that the devices are arranged on the front of the body 1 near the air outlet 7.

As regards the transmitting device 40 and the imaging device 50 in the invention, any type of device may be used and the device may be disposed in any position. For example, these devices may be arranged on central part of the front panel 2. Additionally, the indoor unit 100 includes an annunciator (not illustrated) to provide information about an operation state of the indoor unit using sounds or images.

(Heat Exchanger)

The heat exchanger 4, which is one of components performing a refrigeration cycle, includes a front heat exchanging portion 4*a* positioned substantially parallel to the front panel 2, a front upper heat exchanging portion 4*b* positioned diagonally above the front of the air-sending device 5, and a rear upper heat exchanging portion 4*c* positioned above the rear of the air-sending device 5. The indoor unit 100 further includes a drain pan 8 placed under the front heat exchanging portion 4*a*. The drain pan 8 has an upper surface 8*a* that serves as a drain pan face for actually receiving drain water and has a lower surface 8*b* that defines a front surface of the air path 6.

(Blowing Direction Control Device: Up-Down Deflectors)

The indoor unit 100 includes a blowing direction control device. The blowing direction control device includes a left group 10L of right-left deflectors and a right group 10R of right-left deflectors (hereinafter, referred to collectively as "right-left deflectors 10" and individually as a "right-left deflector 10") to control a blowing direction of indoor air conditioned (hereinafter, referred to as "conditioned air") by the heat exchanger 4 relative to the horizontal direction (right-left direction). The right-left deflectors 10 are arranged in the air path 6 in the vicinity of the air outlet 7. The blowing direction control device further includes up-down deflectors 9 (including a front up-down deflector 9*a* and a rear up-down deflector 9*b*, which are referred to collectively as the "up-down deflectors 9") to control the blowing direction of the conditioned air relative to the vertical direction (up-down direction). The up-down deflectors 9 are arranged in the air outlet 7, serving as an end of the air path 6.

As used herein, the terms "left" and "right" refer to the left and right sides when the room is viewed from the indoor unit 100, namely, in a direction from the rear of the body 1 to the front panel 2.

(Blowing Direction Control Device: Right-Left Deflectors)

The right group 10R of right-left deflectors includes right-left deflectors 10*a*, 10*b*, . . . , and 10*g* which are rotatably arranged on the lower surface 8*b* of the drain pan 8 and are connected by a right connecting rod 20R. The left group 10L of right-left deflectors includes right-left deflectors 10*h*, 10*i*, . . . , and 10*n* which are connected by a left connecting rod 20L.

The right group 10R of right-left deflectors and the right connecting rod 20R constitute a link mechanism. Furthermore, the left group 10L of right-left deflectors and the left connecting rod 20L constitute a link mechanism. The right connecting rod 20R is coupled to right driving unit (not illustrated) and the left connecting rod 20L is coupled to left driving unit 30L.

Accordingly, when the right connecting rod 20R is shifted by the right driving unit, the right-left deflectors 10*a*, 10*b*, . . . , and 10*g* are rotated while being parallel to one another. When the left connecting rod 20L is shifted by the left driving unit 30L, the right-left deflectors 10*h*, 10*i*, . . . , and 10*n* are rotated while being parallel to one another. This allows conditioned air to be blown in the same direction throughout the width of the air outlet 7 or to be blown such that air flow components each corresponding to half the width of the air outlet 7 are blown away from each other or to be blown such that the air flow components each corresponding to half the width of the air outlet 7 hit against each other.

The right-left deflectors 10 in the invention are not limited to the shape illustrated and may have any shape. Furthermore, any number of right-left deflectors 10 may be arranged. In addition, the right-left deflectors 10 may be divided into at least three groups, the right-left deflectors of each group may be rotatably joined to a connecting rod, and the rods may be independently shifted.

(Up-Down Deflectors)

Each up-down deflector 9 has a rotation axis parallel to the horizontal direction (Y direction) and is rotatably attached to the body 1. A rotation shaft of the front up-down deflector 9*a* and a rotation shaft of the rear up-down deflector 9*b* are connected by a link mechanism or gear mechanism and are rotated by a common driving motor.

The up-down deflectors 9 in the invention are not limited to the configuration illustrated. The front up-down deflector 9*a* and the rear up-down deflector 9*b* may be rotated by different driving motors. Alternatively, each of the up-down deflectors 9 may be divided at the center in the lateral direction such that four up-down deflectors 9 are arranged. The up-down deflectors 9 may be rotated independently.

(Autonomous Vacuum Cleaner)

In FIG. 4, the autonomous vacuum cleaner 70 includes a body 71 shaped like a flat container, a receiving unit 72 to receive an operation signal from the indoor unit 100, a dust collecting unit (not illustrated) accommodated in the body 71, a traveling driving unit (not illustrated) accommodated in the body 71, and wheels 73 projecting from a lower surface of the body 71.

Specifically, the autonomous vacuum cleaner 70 receives an operation signal transmitted from the indoor unit 100, suction power of the dust collecting unit is controlled (namely, the rotation speed of a suction fan (not illustrated) is increased or reduced) on the basis of this signal, and a traveling direction and traveling speed are changed (or maintained). The autonomous vacuum cleaner 70 in the invention is not limited to the type illustrated. The body 71 may have any shape other than flat.

(Controller)

The indoor unit 100 includes a controller 60. To provide a comfort air-conditioned environment, the controller 60 has a function (hereinafter, referred to as "air-conditioning control") for controlling the refrigeration cycle, the air-sending device 5, the right-left deflectors 10, and the up-down deflectors 9 and further has a function (hereinafter, referred to as "cleaner control") for controlling the autonomous vacuum cleaner 70.

The controller 60 distinguishes a stationary object which remains still in the room and a moving object which is moving in the room on the basis of an image captured by the imaging device 50, and determines the position and size of the stationary object.

Furthermore, the controller 60 remembers the positions and sizes of stationary objects, such as components (e.g., walls) of the room and furniture (e.g., a desk, a sofa, a bookcase, and a wardrobe). For the convenience of description, the furniture will be referred to as a "stationary three-dimensional object 80". As regards a person (user) staying at a given position in the room, although such a person is a stationary object, the person is not misidentified as a stationary three-dimensional object because human beings have a slightly changing outline and their bodies have no flat or smoothly curved surface.

(Cleaner Control)

The cleaner control of the controller 60 will be described with reference to a flowchart of FIG. 5.

The controller 60 determines whether an "automatic cleaning mode" has been set (S1).

Specifically, the user can set the automatic cleaning mode by operating a remote control (not illustrated) when leaving home. Alternatively, the automatic cleaning mode is automatically set when a predetermined time (e.g., 24 hours) has elapsed since the last automatic cleaning.

If the automatic cleaning mode has been set, the controller 60 determines on the basis of an image captured by the imaging device 50 whether there is a person (user) in a room 90 (S2).

If there is a person in the room 90, the controller 60 does not transmit an operation signal to the autonomous vacuum cleaner 70 (S11), because the autonomous vacuum cleaner 70 is not allowed to operate. If an air-conditioning operation is being executed, the controller 60 continues the operation. If the air-conditioning operation is suspended, the controller 60 continues the suspension (S12).

If there is no person in the room 90 (for example, the user is away from home), the controller 60 controls the autonomous vacuum cleaner 70 to clean the room. In this case, if the air-conditioning operation is being executed (S3), the controller 60 suspends the air-conditioning operation (refrigeration cycle) (S13).

To blow dust off the stationary three-dimensional object 80, the controller 60 rotates the air-sending device 5 and controls the orientations of the right-left deflectors 10 and the up-down deflectors 9 to achieve convergent blow of indoor air to the stationary three-dimensional object 80 (S4). In this case, it is preferable that the blown indoor air directly hit against a top surface of the stationary three-dimensional object 80. Furthermore, the indoor air may be blown in an intermittent manner such that blowing of the air for a predetermined time (e.g., one minute) is alternately allowed and interrupted while blown-off dust falls (for example, for one minute), and such intermittent blow may be repeated multiple times.

In cases where there are a plurality of stationary three-dimensional objects 80, the above-described blow (intermittent blow) is performed for each object in turn.

When air flow in the room settles such that the blown-off dust has fallen down after the air-sending device 5 is stopped at the completion of the convergent blow to the stationary three-dimensional object 80 (for example, when two minutes have elapsed since the termination of the convergent blow) (S5), the controller 60 transmits an operation signal to the autonomous vacuum cleaner 70 to start automatic cleaning (S6).

During the automatic cleaning, the autonomous vacuum cleaner 70 cleans a floor while moving. If the autonomous vacuum cleaner 70 is out of the field of view of the imaging device 50, the autonomous vacuum cleaner 70 is actually traced by the controller 60.

Specifically, the controller 60 remembers the positions of the walls of the room and the position and size of the stationary three-dimensional object 80. For example, if the autonomous vacuum cleaner 70 enters a space under the stationary three-dimensional object 80 or a blind spot of the imaging device 50 such that the cleaner is out of the field of view of the imaging device 50, the controller 60 estimates the position of the autonomous vacuum cleaner 70 by calculation based on a moving direction and a moving speed of the autonomous vacuum cleaner 70. Accordingly, if the autonomous vacuum cleaner 70 is out of the field of view of the imaging device 50, the autonomous vacuum cleaner 70 can be stopped and moved backward so as to prevent collision with the wall or can be allowed to travel along the wall. When the imaging device 50 again comes into the field of view of the imaging device 50, the controller 60 determines the position of the autonomous vacuum cleaner 70 on the basis of an actually captured image and uses the position as a correct position for the next control.

The autonomous vacuum cleaner 70 may have any movement path (moving manner). While avoiding the stationary three-dimensional object or entering a space under the stationary three-dimensional object, the autonomous vacuum cleaner 70 may move along many lines parallel to one wall in principle, or move spirally around the center of the room.

As regards a dusty area (e.g., an area near or surrounding the stationary three-dimensional object or an area (corresponding to a "living zone") in which a person is often present, it is preferable that the moving speed of the autonomous vacuum cleaner 70 be reduced, the amount of overlapping between cleaning ranges (the extent of overlapping between a cleaning range during advancing and a cleaning range during returning) be increased, and/or a dust suction rate be increased in such an area (these actions will be referred to collectively as "performing (allowing) powerful cleaning").

At the termination of movement in the room, the autonomous vacuum cleaner 70 completes a series of automatic cleaning steps (S7) at a position where the cleaning operation is finished or after moving to a predetermined standby position. The control is terminated.

(Advantages)

Since the controller 60 performs the air-conditioning control and the cleaning control, the indoor unit 100 does not need an additional device controller (provided with, for example, a camera and transmitting unit) for cleaner control. Advantageously thereby, the autonomous vacuum cleaner 70 can be controlled at low cost. In addition, since it is unnecessary to attach an additional object (device controller dedicated for cleaner control) on the ceiling, a desirable appearance of the room can be maintained.

Furthermore, when it is determined that there is no person in the room 90, the autonomous vacuum cleaner 70 is permitted to move. Accordingly, there is no interference with a person, so that an algorithm for movement can be simplified.

In addition, since the convergent blow of indoor air to the stationary three-dimensional object is performed before start of cleaning, dust on the stationary three-dimensional object can be allowed to fall on the floor. In other words, dust deposited on places other than the floor can be removed, so that the room can be subjected to thorough cleaning.

When air flow in the room settles after the air-sending device 5 is stopped, the autonomous vacuum cleaner 70 starts cleaning. Advantageously, dust having fallen from the stationary three-dimensional object can be prevented from being stirred up.

As regards an area in which dust on the stationary three-dimensional object 80 will fall (for example, an area near or surrounding the stationary three-dimensional object 80 or an area on the leeward side of the stationary three-dimensional object 80) or an area (corresponding to the "living zone") in which a person is often present, more powerful cleaning is performed in this area than that in the other area. Advantageously, this facilitates dust removal and the room can be cleaned more thoroughly.

In the above description, automatic cleaning is executed after the convergent blow of indoor air to the stationary three-dimensional object 80. The convergent blow of indoor air to the stationary three-dimensional object 80 may be omitted and only automatic cleaning may be executed.

Furthermore, although automatic cleaning is executed while a person is away from the room in the above description, automatic cleaning may be executed while a person is present in the room. In this case, the autonomous vacuum cleaner 70 may move within an area with no interference (contact) with the person or may perform a silent operation (in which the rate of suction of indoor air is reduced) in an area near the person or in the entire room.

Example

Referring to FIG. 6(*a*), the indoor unit 100 is disposed on one wall (back wall) 91 of the room 90. A sideboard 81 and a television stand 83 (on which a television 82 is placed) are arranged along a left wall 92. A table 84 and a sofa 85 are arranged at substantially the center of the room 90. For the convenience of description, a stationary three-dimensional object is not disposed in an area near a wall (front wall) 93 opposite the wall 91.

First, the indoor unit 100 blows indoor air (unconditioned air) W81 to the sideboard 81 positioned closest to the indoor unit 100 such that the blown air converges on a top surface of the sideboard 81. In this case, blowing of the indoor air W81 for a predetermined time (e.g., one minute) is performed multiple times (e.g., three times) at regular intervals (e.g., one minute).

Then, the indoor unit 100 sequentially blows indoor air W83, indoor air W84, and indoor air W85 to the television stand 83, the table 84, and the sofa 85, respectively, such that the blown air converges on such a target in the same way.

The blown indoor air, serving as a given flux, flows while mixing with ambient air and has accordingly some degree of spread. Therefore, strictly, the blown indoor air does not converge on and hit against the top surface of, for example, the sideboard 81.

In FIG. 6(*b*), the controller 60 allows the autonomous vacuum cleaner 70 to start automatic cleaning when a predetermined time (e.g., three minutes) has elapsed since the termination of blowing of the indoor air W85 and air flow in the room 90 settles.

Specifically, the autonomous vacuum cleaner 70 starts moving parallel to the wall 92 from a home position (corresponding to a standby position or storage position) to the indoor unit 100 (hereinafter, referred to as "forward movement") while sucking dust on a floor 95. Upon movement by a certain distance, the autonomous vacuum cleaner 70 moves parallel to the wall 91 (hereinafter, such motion will be referred to as "lateral movement"). Then, the autonomous vacuum cleaner 70 moves forward to the indoor unit 100 or away from the indoor unit 100 (hereinafter, such motion will be referred to as "backward movement") while being parallel to the wall 92.

In this case, convergent blowing of, for example, the indoor air W81 has allowed dust on the top surface of the sideboard 81 and the like to fall downward. Accordingly, the dust may be in an area near the sideboard 81 and an area on the leeward side of the sideboard 81 relative to the indoor air W81 and the like.

The autonomous vacuum cleaner 70 increases suction power, reduces a distance of lateral movement in order to increase the amount of overlapping of a cleaning range during forward movement and that during backward movement, or reduces a moving speed during forward and backward movements in a dust fall area 96 in the surrounding of the sideboard 81 and the television stand 83 and a dust fall area 97 in the surrounding of the table 84 and the sofa 85.

Furthermore, since a person does not often enter an area 98 (hereinafter, referred to as a "non-living zone" which is not a "living zone") near the corner between the wall 91 and a wall 94, the autonomous vacuum cleaner 70 does not perform automatic cleaning in the non-living zone 98.

Although the above-described automatic cleaning manner changes depending on area of the floor 95, the present invention is not limited to this example. The entire floor 95 (excluding an area, for example, the sideboard 81, in which the autonomous vacuum cleaner 70 cannot enter) in the room 90 may be cleaned in the same automatic cleaning manner.

Embodiment 2

Figure 7:
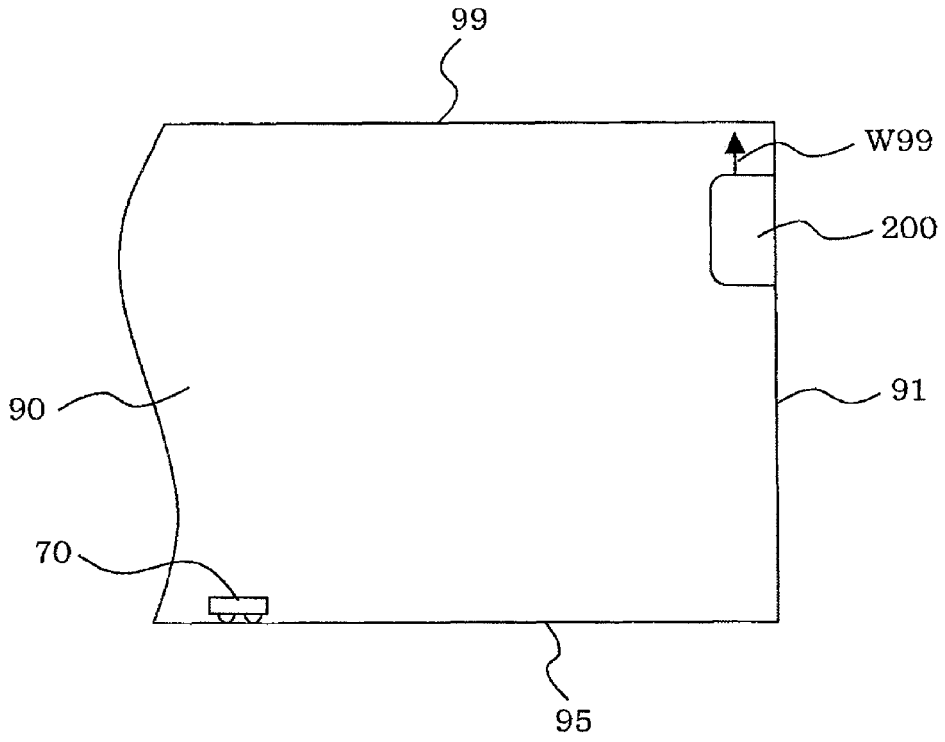
FIG. 7 is a side view that explains an air-conditioning apparatus indoor unit according to Embodiment 2 of the invention and illustrates convergent blow.

FIG. 7 is a diagram explaining an air-conditioning apparatus indoor unit according to Embodiment 2 of the invention and is a side view illustrating convergent blow. The same components as those in Embodiment 1 are designated by the same reference numerals and redundant description is omitted.

In FIG. 7, an air-conditioning apparatus indoor unit (hereinafter, referred to as an "indoor unit") 200 can reverse the direction of air sending by the air-sending device 5 in the indoor unit 100. Specifically, the air-sending device 5 can rotate (forward) in a predetermined direction to suck indoor air through the air inlet 3 and blow the air from the air outlet 7 and can rotate (backward) in the inverse direction of the predetermined direction to suck indoor air through the air outlet 7 and blow the air through the air inlet 3.

Accordingly, the indoor unit 200 blows indoor air W99 through the air inlet 3 to a ceiling 99 before automatic cleaning. The indoor air W99 is reflected by the ceiling 99, thus blowing dust off a top surface of the indoor unit 200. The top surface of the indoor unit 200 can therefore be cleaned. As regards such a blowing manner, intermittent and multiple blowing is preferably performed in a manner similar to the indoor unit 100.

An automatic cleaning manner after blowing dust off the top surface of the indoor unit 200 is the same as that in the indoor unit 100 according to Embodiment 1.

Furthermore, the order (first and second) of convergent blow to the stationary three-dimensional object 80 and the ceiling 99 is not limited. In cases where there are a plurality of stationary three-dimensional objects 80, convergent blow to the stationary three-dimensional objects 80 may be started after convergent blow to the ceiling 99. Alternatively, convergent blow to the ceiling 99 may be performed at the completion of convergent blow to each of the stationary three-dimensional objects 80. Alternatively, convergent blow to one of the stationary three-dimensional objects 80 may be performed, convergent blow to the ceiling 99 may then be performed, and after that, convergent blow to the other stationary three-dimensional objects 80 may be performed.

Embodiment 3

Figure 8:
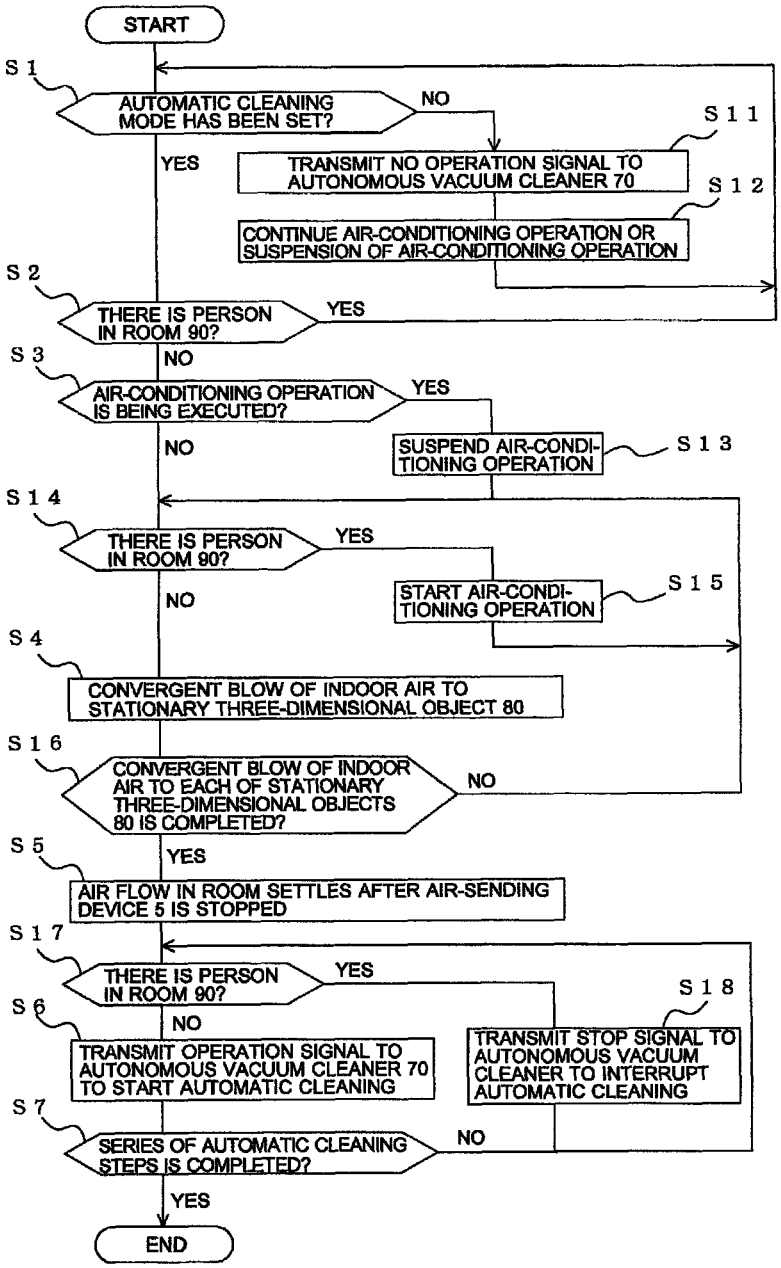
FIG. 8 is a flowchart explaining the steps of automatic cleaning by an air-conditioning apparatus indoor unit according to Embodiment 3 of the invention.

FIG. 8 is a flowchart that explains an air-conditioning apparatus indoor unit according to Embodiment 3 of the invention and explains the steps of automatic cleaning. The same steps as those in Embodiment 1 are designated by the same reference numerals and redundant description is omitted.

The air-conditioning apparatus indoor unit (not illustrated) that executes control illustrated in FIG. 8 includes the same components as those of the indoor unit 100 according to Embodiment 1 but the manner of automatic cleaning differs from that in Embodiment 1. Specifically, in Embodiment 1, a series of convergent blows to the stationary three-dimensional objects 80 and the movement of the autonomous vacuum cleaner are successively performed mainly on the assumption that the user is away from home. On the other hand, the indoor unit according to Embodiment 3 performs convergent blow to one stationary three-dimensional object 80 (for example, the sideboard 81 (refer to FIG. 6(*a*))) (S4) and then determines whether convergent blow of indoor air to each of the stationary three-dimensional objects 80 has been completed (S16) and further determines whether there is a person in the room 90 (S14) before convergent blow to another stationary three-dimensional object 80 (e.g., the television stand 83 (refer to FIG. 6(*a*))).

If there is a person in the room, the air-conditioning operation is started (S15) instead of convergent blow to another stationary three-dimensional object 80. On the other hand, if there is no person, convergent blow to another stationary three-dimensional object 80 is continuously performed (S4).

As described above, during convergent blow to the stationary three-dimensional objects 80, the indoor unit according to Embodiment 3 interrupts the convergent blow when the user (person) returns to the room. Accordingly, the user is not exposed to an undesired air-conditioning environment or dust falling from the stationary three-dimensional object 80.

When air flow in the room 90 settles (S5) after convergent blow of indoor air to each of the stationary three-dimensional objects 80 is completed (S16), an operation signal is transmitted to the autonomous vacuum cleaner 70 to start automatic cleaning (S6), as long as there is no person in the room 90 (S17). On the other hand, if the user (person) returns to the room (S17), a stop signal is transmitted to the autonomous vacuum cleaner 70 to interrupt automatic cleaning (S18). At the completion of a series of automatic cleaning steps (S7), control is terminated.

In the case of interruption of automatic cleaning, the autonomous vacuum cleaner 70 may be stopped (on standby) at a position upon interruption of automatic cleaning or may return to the predetermined home position (corresponding to the standby position or storage position). If the autonomous vacuum cleaner 70 returns to the predetermined home position, since the controller 60 determines the position of the user (person) in the room, it selects a path with no interference with the user, and allows the autonomous vacuum cleaner 70 to move.

Embodiment 4

Figure 9:
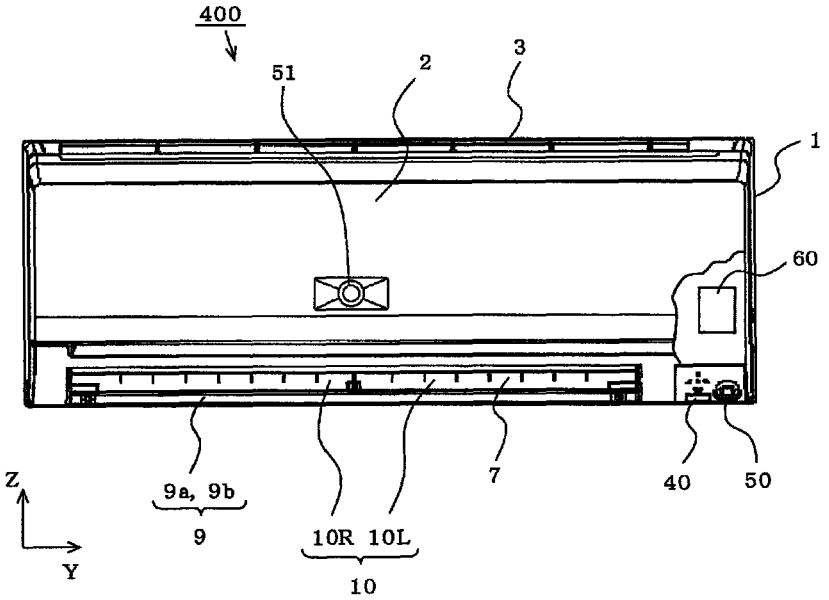
FIG. 9 is a front view explaining an air-conditioning apparatus indoor unit according to Embodiment 4 of the invention.

FIG. 9 is a front view explaining an air-conditioning apparatus indoor unit according to Embodiment 4 of the invention. The same components as those in Embodiment 1 are designated by the same reference numerals and redundant explanation is omitted.

In FIG. 9, an air-conditioning apparatus indoor unit (hereinafter, referred to as an "indoor unit") 400 includes an infrared sensor 51 in addition to the same components as those of the indoor unit 100 according to Embodiment 1 and is configured such that the controller 60 transmits an operation signal to the autonomous vacuum cleaner 70, the signal being based on an image captured by the imaging device 50 and information about a temperature measured by the infrared sensor 51.

Specifically, if the user (person) is present in the room, the indoor unit 400 can calculate the degree of activity of the user on the basis of the information about the temperature of the user measured by the infrared sensor 51. When the calculated degree of activity is less than or equal to a predetermined value, therefore, the indoor unit 400 determines that the user is in a relaxed state, for example, the user is "sleeping" or "intoxicated with music", and does not transmit an operation signal to the autonomous vacuum cleaner 70.

The indoor unit 400 therefore corresponds to a modification of the indoor unit 100 according to Embodiment 1 and is configured to take a user's state (relaxed state) into consideration when determining whether to skip convergent blow to any stationary three-dimensional object 80 and allow the autonomous vacuum cleaner 70 to execute automatic cleaning.

Furthermore, the indoor unit 400 corresponds to a modification of the indoor unit 200 according to Embodiment 3 and is configured to determine "whether the calculated degree of activity is less than or equal to the predetermined value" instead of the determination as to "whether there is a person in the room 90" (S17 in FIG. 8) just before execution of automatic cleaning by the autonomous vacuum cleaner 70.

REFERENCE SIGNS LIST

1, body; 2, front panel; 3, air inlet; 4, heat exchanger; 4*a*, front heat exchanging portion; 4*b*, front upper heat exchanging portion; 4*c*, rear upper heat exchanging portion; 5, air-sending device; 6, air path; 7, air outlet; 8, drain pan; 8*a*, upper surface; 8*b*, lower surface; 9, up-down deflector; 9*a*, front up-down deflector; 9*b*, rear up-down deflector; 10, right-left deflector; 10L, left group of right-left deflectors; 10R, right group of right-left deflectors; 10*a*, right-left deflector; 10*h*, right-left deflector; 20L, left connecting rod; 20R, right connecting rod; 30L, left driving unit; 40, transmitting device; 50, imaging device; 51, infrared sensor; 60, controller; 70, autonomous vacuum cleaner; 71, body; 72, receiving unit; 73, wheel; 80, stationary three-dimensional object; 81, sideboard; 82, television; 83, television stand; 84, table; 85, sofa; 90, room; 91, wall (back wall); 92, wall (left wall); 93, wall (front wall); 94, wall (right wall); 95, floor; 96, dust fall area; 97, dust fall area; 98, non-living zone; 99, ceiling; 100, indoor unit (Embodiment 1); 200, indoor unit (Embodiment 2); and 400, indoor unit (Embodiment 4).

The invention claimed is:

1. An air-conditioning apparatus indoor unit comprising:

a body disposed on an inside wall of a room, the body having an air inlet and an air outlet that form an air path;

an air-sending device configured to suck indoor air through the air inlet, and further configured to send the indoor air through the air path leading to the air outlet;

a heat exchanger, disposed in the air path, configured to execute part of a refrigeration cycle;

a blowing direction control device, disposed in the air outlet, configured to control a blowing direction of air conditioned by the heat exchanger;

an imaging device configured to capture an image of an inside of the room; and a controller with a processor, the processor being programmed to:

control the air-sending device, the heat exchanger, and the blowing direction control device based on the image captured by the imaging device;

in an automatic cleaning mode, control an autonomous vacuum cleaner based on the image captured by the imaging device; and in the automatic cleaning mode:

when having determined on the basis of the image captured by the imaging device that there is no person in the room, control the air-sending device and the blowing direction control device to blow the indoor air to a stationary three-dimensional object for a predetermined time, the stationary three-dimensional object being identified based on the image captured by the imaging device, and after the predetermined time elapses, control the air-sending device to stop blowing air, and cause the controller to issue an operation instruction for the autonomous vacuum cleaner to clean and move, wherein the processor of the controller is further programmed to:

control the heat exchanger to suspend the refrigeration cycle before controlling the air-sending device, and control the blowing direction control device to blow the indoor air to the stationary three-dimensional object for the predetermined time.

2. The air-conditioning apparatus indoor unit of claim 1, wherein when having determined that a person has entered the room during air blow to a stationary three-dimensional object in the automatic cleaning mode after a determination based on an image captured by the imaging device that there is no person in the room, the controller interrupts the air blow to the stationary three-dimensional object and, after that, when having determined again that there is no person in the room, restarts the air blow to the stationary three-dimensional object, and wherein when having issued an operation instruction for the autonomous vacuum cleaner to clean and move in response to a determination that there is no person in the room, the determination being made after the air blow is stopped, and then having determined that a person has entered the room, the controller issues a stop instruction for the autonomous vacuum cleaner to stop cleaning and moving and, after that, when having determined that there is again no person in the room, issues another operation instruction for the autonomous vacuum cleaner to again clean and move.

3. The air-conditioning apparatus indoor unit of claim 1, wherein the processor of the controller is further programmed to:

analyze multiple images captured by the imaging device to identify an area in which a person is often present, and cause the controller to issue an operation instruction to the autonomous vacuum cleaner to increase a suction rate in the area in which a person is often present than that in other areas.

4. The air-conditioning apparatus indoor unit of claim 1, further comprising an infrared sensor configured to detect an infrared radiation in the room, wherein the processor of the controller is further programmed to:

control an autonomous vacuum cleaner based on information about a temperature measured by the infrared sensor, and in an automatic cleaning mode:

calculate a degree of activity of a person in the room based on the temperature measured by the infrared sensor, cause the controller to issue a stop instruction to the autonomous vacuum cleaner when the calculated degree of activity is less than or equal to a reference degree of activity, and cause the controller to issue an operation instruction to the autonomous vacuum cleaner when the calculated degree of activity exceeds the reference degree of activity.

5. The air-conditioning apparatus indoor unit of claim 1, wherein the automatic cleaning mode is set each time an accumulated operation time obtained by accumulating operation time of the refrigeration cycle reaches a reference accumulated operation time.

6. The air-conditioning apparatus indoor unit of claim 1, wherein the automatic cleaning mode is set by a user.

7. The air-conditioning apparatus indoor unit of claim 1, wherein the autonomous vacuum cleaner includes a dust capturing unit that captures dust based on an operation instruction from the controller, and a traveling unit that autonomously travels based on an operation instruction from the controller.

8. The air-conditioning apparatus indoor unit of claim 1, wherein the processor of the controller is further programmed to, during the predetermined time, control the air-sending device to interrupt blowing the indoor air to the stationary three-dimensional object multiple times.

9. The air-conditioning apparatus indoor unit of claim 1, wherein the controller issues an operation instruction to the autonomous vacuum cleaner to increase a suction rate in an area near or surrounding the stationary three-dimensional object than that in other areas.

10. The air-conditioning apparatus indoor unit of claim 1, wherein the air-sending device includes the air path extending from the air inlet to the air outlet and an inverse air path extending from the air outlet to the air inlet, and wherein the processor of the controller is further programmed to control the air sending device to blow indoor air passing through the inverse air path to a ceiling of the room before, during, or after the predetermined time during which the sending device blows the indoor air to the stationary three-dimensional object.

11. An air-conditioning apparatus indoor unit comprising:

a body disposed on an inside wall of a room, the body having an air inlet and an air outlet that form an air path;

an air-sending device configured to suck indoor air through the air inlet, and further configured to send the indoor air through the air path leading to the air outlet;

a heat exchanger, disposed in the air path, configured to execute part of a refrigeration cycle;

a blowing direction control device, disposed in the air outlet, configured to control a blowing direction of air conditioned by the heat exchanger;

an imaging device configured to capture an image of an inside of the room; and a controller with a processor, the processor being programmed to:

control the air-sending device, the heat exchanger, and the blowing direction control device based on the image captured by the imaging device;

in an automatic cleaning mode, control an autonomous vacuum cleaner based on the image captured by the imaging device; and in the automatic cleaning mode:

when having determined on the basis of the image captured by the imaging device that there is no person in the room, control the air-sending device and the blowing direction control device to blow the indoor air to a stationary three-dimensional object for a predetermined time, the stationary three-dimensional object being identified based on the image captured by the imaging device, and after the predetermined time elapses, control the air-sending device to stop blowing air, and cause the controller to issue an operation instruction for the autonomous vacuum cleaner to clean and move, wherein the processor of the controller is further programmed to, during the predetermined time, control the air-sending device to interrupt blowing the indoor air to the stationary three-dimensional object multiple times.

12. The air-conditioning apparatus indoor unit of claim 11, wherein the controller issues an operation instruction to the autonomous vacuum cleaner to increase a suction rate in an area near or surrounding the stationary three-dimensional object than that in other areas.

13. The air-conditioning apparatus indoor unit of claim 11, wherein the air-sending device includes the air path extending from the air inlet to the air outlet and an inverse air path extending from the air outlet to the air inlet, and wherein the processor of the controller is further programmed to control the air sending device to blow indoor air passing through the inverse air path to a ceiling of the room before, during, or after the predetermined time during which the sending device blows the indoor air to the stationary three-dimensional object.

14. The air-conditioning apparatus indoor unit of claim 11, wherein the automatic cleaning mode is set each time an accumulated operation time obtained by accumulating operation time of the refrigeration cycle reaches a reference accumulated operation time.

15. The air-conditioning apparatus indoor unit of claim 11, wherein the automatic cleaning mode is set by a user.

16. The air-conditioning apparatus indoor unit of claim 11, wherein the autonomous vacuum cleaner includes a dust capturing unit that captures dust based on an operation instruction from the controller, and a traveling unit that autonomously travels based on an operation instruction from the controller.

* * * * *